US005594963A

United States Patent [19]

Berkowitz

[11] Patent Number: 5,594,963

[45] Date of Patent: Jan. 21, 1997

[54] PRESSURE RELIEF AIR MATTRESS AND RELATED SYSTEM

[75] Inventor: Steven A. Berkowitz, San Antonio, Tex.

[73] Assignee: Kinetic Concepts, Inc., San Antonio, Tex.

[21] Appl. No.: 608,996

[22] Filed: Mar. 11, 1996

Related U.S. Application Data

[63] Continuation of Ser. No. 309,557, Sep. 20, 1994, abandoned, which is a continuation of Ser. No. 932,873, Aug. 20, 1992, abandoned.

[51] Int. Cl.[6] ..... A61G 7/04

[52] U.S. Cl. ..... 5/713; 5/914

[58] Field of Search ..... 5/953, 955, 456, 5/469, 914

[56] References Cited

U.S. PATENT DOCUMENTS

| | | | |
|---|---|---|---|
| 3,644,950 | 2/1972 | Lindsay, Jr. | 5/469 X |
| 4,394,784 | 7/1983 | Swenson et al. . | |
| 4,694,520 | 9/1987 | Paul et al. . | |
| 4,797,962 | 1/1989 | Goode . | |
| 4,896,389 | 1/1990 | Chamberland . | |
| 4,949,412 | 8/1990 | Goode | 5/453 |
| 5,022,110 | 6/1991 | Stroh | 5/455 |
| 5,090,077 | 2/1992 | Caden et al. | 5/453 A |
| 5,121,512 | 6/1992 | Kaufmann | 5/453 |
| 5,168,589 | 12/1992 | Stroh et al. | 5/453 X |
| 5,182,826 | 2/1993 | Thomas et al. . | |
| 5,267,364 | 12/1993 | Volk | 5/453 |

FOREIGN PATENT DOCUMENTS

| | | | |
|---|---|---|---|
| 879575 | 8/1971 | Canada | 5/455 |
| 969367 | 9/1964 | United Kingdom | 5/453 |
| 1545806 | 5/1979 | United Kingdom | 5/455 |

*Primary Examiner*—Michael F. Trettel

[57] ABSTRACT

A pressure-relieving therapeutic mattress system that uniquely combines three releasably connected main air cushions that are separately controlled for supporting corresponding portions of a patient at minimal patient interface pressures, together with a sculpted foam sub-mattress supported on a versatile, lightweight frame having a specially-adapted hard pan surface and an efficient, lightweight, variable-speed air supply system.

5 Claims, 15 Drawing Sheets

PRESSURE RELIEF AIR MATTRESS AND RELATED SYSTEM

This application is a continuation of application Ser. No. 08/309,557, filed Sep. 20, 1994, now abandoned, which is a continuation of application No. 907/932,873, filed Aug. 20, 1992, now abandoned.

BACKGROUND OF THE INVENTION

1. Field of the Invention

The present invention relates to therapeutic beds and mattress systems designed to prevent, reduce and treat complications of immobility. More particularly, the present invention relates to air (or air-and-foam composite) mattresses which provide therapeutic benefits in part by reducing patient interface pressures, thereby enabling better circulation in the patient, in conjunction with related systems that combine to provide a bed ideal for easy use in home settings and the like.

2. Background References

The complications of immobility have long plagued the health care industry. Decubitis ulcers (i.e., bed scores) are common examples of such complications, although many others have long been documented and are well known. The need to address such complications has been even more important in the latter half of this century, as advanced technology sustains life longer and longer after patients become bedridden and as patients continue to be discharged from the hospital setting sooner and sicker. Many have attempted to address such complications with various therapeutic air (or air-and-foam composite) mattresses. But, few if any have been able to produce an effective therapeutic mattress system that is lightweight and easily transported and can be used and serviced cost affordably, for use in the home setting.

It is known in the art to provide an air mattress having multiple cushions that make up an integral air mattress. Applicant's own previous mattresses have employed this technique, such as described in applicant's co-pending application Ser. No. 07/714,379 filed Jun. 11, 1991 now U.S. Pat. No. 5,168,589, and entitled Pressure Reduction Air Mattress and Overlay. The disadvantages of such constructions will be evident to those of ordinary skill in the art such as the fact that integral mattresses must be handled and disinfected as a unit, rather than separately. Replacement costs are likewise heightened due to the practicality that the entire mattress must be replaced rather than separable elements.

Examples of commercially available mattresses that address some of the prior art concerns are as the "First Step" family of mattress systems manufactured by the present Applicant, Kinetic Concepts, Inc. of San Antonio, Tex. One member of that family, the "First Step M.R.S." is a mattress replacement system that includes a three-sectioned air mattress supported on a thin foam sub-mattress, with a lightweight blower designed to hook to the footboard of an existing bed frame. None of the "First Step" products are made integral with a frame, although many other available air and foam mattresses are.

SUMMARY OF THE INVENTION

The present invention represents an improved and novel system over the prior art. It is characterized by a number of advantages which increase its utility over the prior art devices, including the innovative integration of a novel mattress structure with a lightweight, versatile frame and an efficient air supply system. Such a system is ideal for patients who would benefit from a pressure relieving surface assisting in the prevention and counteraction of skin breakdown as well as from enhanced circulation, or to assist in pain management.

A primary object of the present invention is to provide an improved therapeutic support system for a variety of patients, including many who are immobile for varied lengths of time. Providing such a system with a lightweight, versatile structure that can be easily disassembled and moved through narrow halls, doors, up stairs and the like is also an important object. Another object is to provide a therapeutic, pressure-relieving mattress that includes separable air cushions for ease in handling, cleaning and service. Simplicity, ease of use, durability, and cost efficient therapy are still other objects. A related object is to provide such a mattress which does not compromise the safety or therapeutic benefits for critically ill patients.

Many other objects will be evident to those of ordinary skill in the art in view of the foregoing and following descriptions, particularly when considered in light of the prior art of the present invention. Such objects include minimizing manufacturing and service costs and complexities while maximizing the utility, efficiency, durability and benefits of a mattress product designed for use in home settings and the like, according to the prescription of a medical doctor.

The present invention addresses such objects by providing a mattress system which includes the elements and serves the purposes described hereafter and as set forth in the claims appended hereto.

These and many other features, objects and advantages of the invention will be evident to those of ordinary skill in the art from the foregoing and following descriptions, particularly when viewed in light of the prior art and in conjunction with the accompanying drawings and appended claims.

BRIEF DESCRIPTION OF THE DRAWINGS

To the extent not referenced below, brief descriptions of the drawings are incorporated in, and will be understood in view of, the following more detailed description of preferred embodiments. With reference to the preferred embodiment.

DETAILED DESCRIPTION OF PREFERRED EMBODIMENTS

Figure 1:
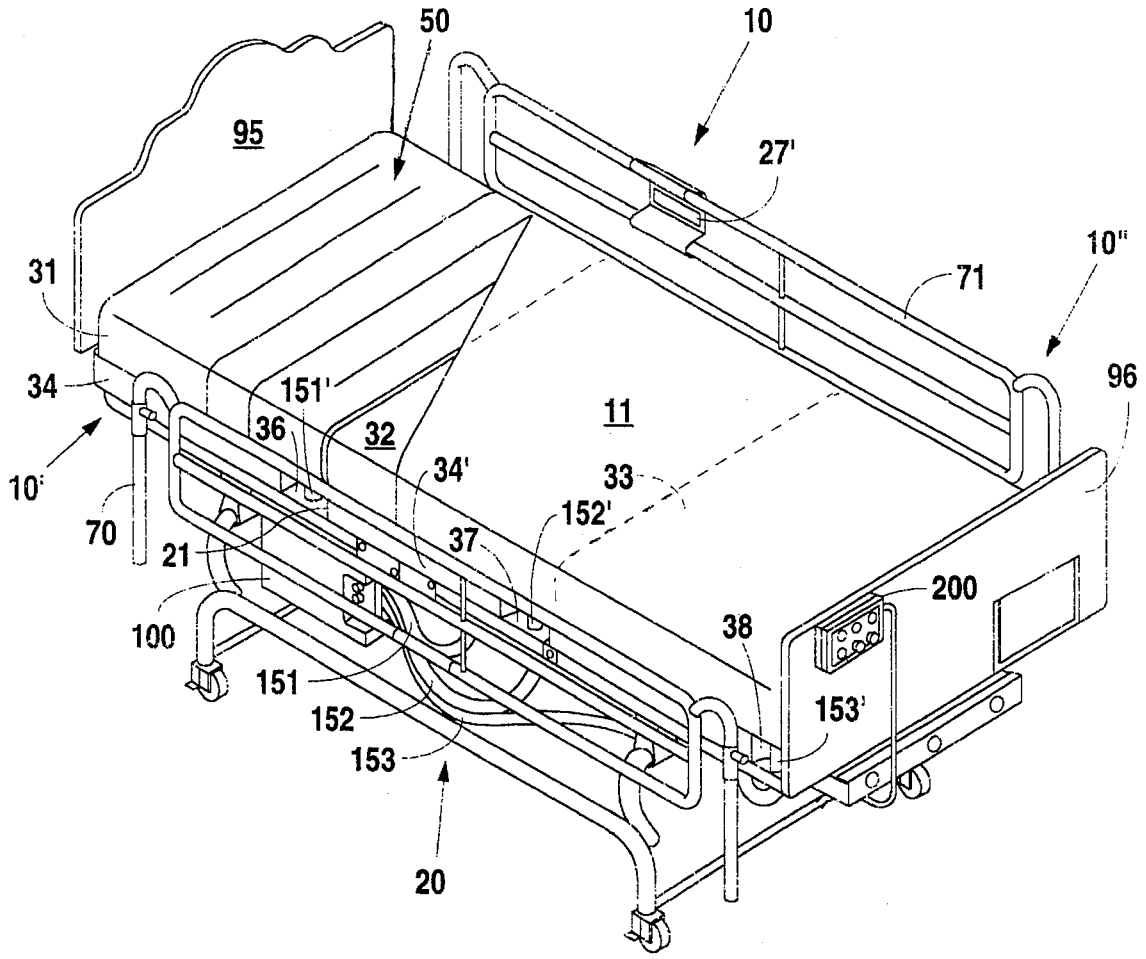
FIG. 1 shows an isometric perspective of bed 10.

Referring to the accompanying drawings (FIGS. 1–15), there is shown an air bed 10 which is one of Applicant's preferred embodiments constructed according to the teachings of the present invention. Air bed 10 is a patient support of the type commonly referred to as a low-air-loss bed and is designed to provide pressure relief for a patient supported thereon. "Pressure relief" is a common reference in this field meaning that the interface pressure between the patient and the bed's patient supporting surfaces (namely cover sheet 11 of bed 10) are generally maintained below capillary closure pressures (generally considered to be 32 millimeters mercury) at all points on the patient's body when the patient is lying in the supine position. Such pressure relief helps to reduce and treat complications of immobility such as pressure sores and similar or related ailments. Such a bed 10 is primarily indicated for pressure ulcers, skin flaps and grafts, draining wounds, advanced arthritis, oncology, chronic musculoskeletal disorders, chronic neurological disorders, and pain management, although it is not recommended for patients requiring cervical traction or patients with spinal cord injuries. Evenly distributed pressures also tend to make for a more comfortable resting surface.

Unlike many other beds of this type, bed 10 is also easily disassembled to allow set-up in rooms upstairs and beyond narrow hallways and doorways; is lightweight to allow set-up in rooms that cannot structurally support heavy air-fluidized or conventional low-air-loss specialty beds; is simplified in operation for the care giver and patient in the home environment and is cost efficient in use.

As of the filing date of this application, bed 10 (or a bed substantially like bed 10 in most respects) will be commercially available from Applicant Kinetic Concepts, Inc. or its subsidiary Kinetic Concepts Therapeutic Services, Inc., both based in San Antonio, Tex., under the trademark "HomeKair Bed". Other equivalent beds may also soon be commercially available through said Applicant. To any extent not set forth clearly herein (if any), the features of bed 10 and how to make and use it will be readily understood by those of ordinary skill in the art from an inspection of the said HomeKair Bed made in light of this description and the accompanying drawings.

As for components, bed 10 basically comprises frame assembly 20, mattress assembly 50, and air supply unit 100, together with various other components linking those three main assemblies. Each of these assemblies 20, 50 and 100 will be described in more detail below. The overall interplay of the assemblies 20, 50 and 100 may be best understood with reference to FIG. 1, wherein it is shown that frame assembly 20 supports both mattress assembly 50 and air supply unit 100, and the air supply unit 100 supplies air to mattress assembly 50 through air hoses 151–153 for controlling inflation thereof.

Referring to FIGS. 1–6, mattress assembly 50 preferably comprises three identical inflatable air cushions 31–33 connected to one another and mounted atop a foam sub-mattress 34. Sub-mattress 34 is substantially rectangular in shape and is roughly the size of a standard hospital mattress from the plan view, although three cut-outs 36–38 are sculpted into its shape along one side 34'. Cut-outs 36–38 serve principally to allow passage of air hoses 151–153 to cushions 31–33, respectively. As best shown in FIGS. 2A and 2B, sub-mattress 34 has a foam core 35 (FIG. 2A) enclosed within cover 40 (FIG. 2B). Cut-outs 36–38 are formed by sculpting them into the side 35' of foam core 35, and cover 40 is adapted to fit the contour of foam core 35. Preferably, core 35 is a urethane foam formulated with an antimicrobial agent (such as "Vinyzene" brand antimicrobial agent), as per Morton international recommendations for urethane foam cushion products. As with other foam mattresses, Sub-mattress 34 is also designed to meet applicable fire code requirements. Many other foam substitutes or cushions with or without flame barriers may also be employed for the same purpose as sub-mattress 34 within the discretion of any manufacturer, with commensurate consequences. The provision of pan surface 21 beneath sub-mattress 34 not only helps provide an ideal patient support, but is also thought to aid in inhibiting the spread of flames in the case of fire.

An important purpose of foam core 35 is to provide a sub-cushion in addition to air cushions 31–33 to cushion a patient supported on mattress assembly 50 whenever any one or more of air cushions 31–33 bottoms. "Bottoming" of an air cushion refers to an occasion in which the upper surface of the air cushion contacts its lower surface, due primarily to the weight or weight distribution of a patient supported thereon as compared to the amount of cushion inflation. Bottoming of the patient may occur in a variety of circumstances, either intentionally (such as to enable ingress and egress from bed 10) or inadvertently (such as in the case of a power outage which causes deflation of cushions 31–33).

Figure 2A:
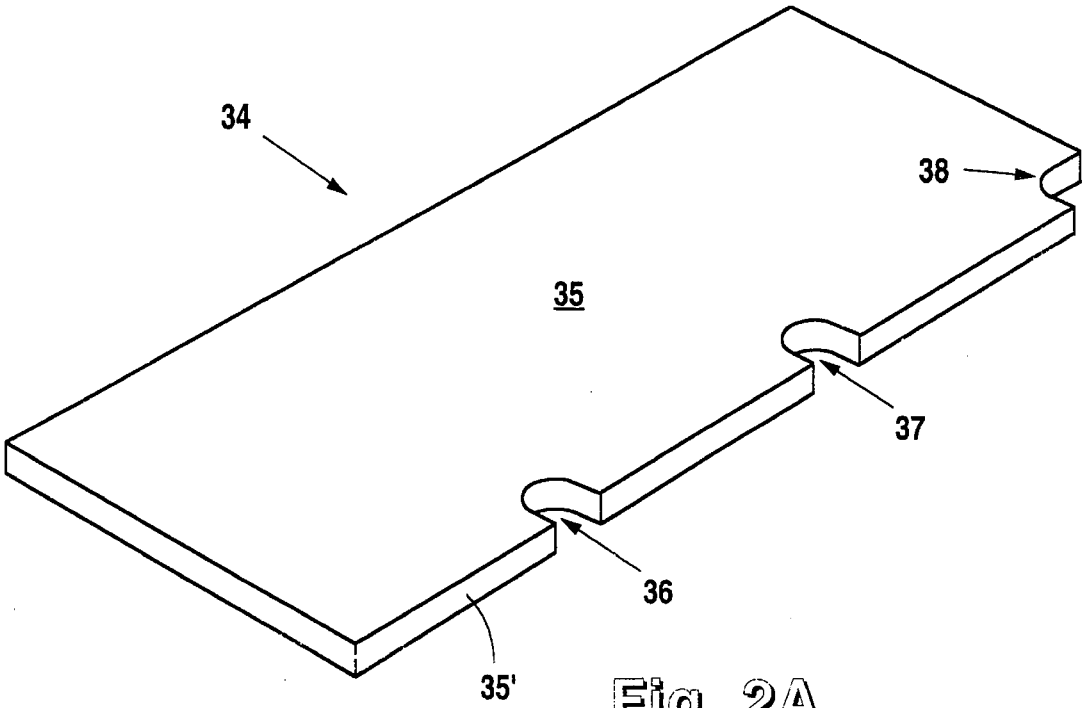
FIG. 2A shows an isometric perspective of the foam core 35 of sub-mattress 34.

While one of the primary purposes of pressure relief mattresses such as mattress assembly 50 is to minimize patient interface pressures, the many benefits of the cushion nature of sub-mattress 34 will be evident to those of skill in the art. As suggested above, cut-outs 36–38 are sculpted into the perimeter of foam core 35 along one side 35' in the preferred embodiment, in part to enable passage of hoses 151–153 from beneath sub-mattress 34 to the cushions 31–33 (respectively) above sub-mattress 34. Cut-outs 36–38 also help maintain the position of such hoses 151–153 and, hence, the cushions 31–33 connected thereto. Cut-outs 36–38 are positioned in correspondence with the air nipples 138 (FIGS. 5B–5D) of cushions 31–33 when mattress 50 is properly oriented. Such positioning also helps ensure minimum patient interface pressures in the event the patient should bottom against the top of one of such nipples 138. Nipples 138, which are preferably rigid or semi-rigid in order to help prevent kinking of the hoses 151–153, might otherwise cause localized pressure points when a patient sits or lies against nipple 138. The dimensions shown in FIG. 2A are preferred for achieving this end in conjunction with the three identical cushions 31–33. The thickness of core 35 (roughly 3 inches) is relatively thin for a foam mattress. The thin nature of core 35 is preferred in order to minimize the overall mattress height of mattress assembly 50 while still reducing patient interface pressures even when cushions 31–33 are deflated.

Figure 2B:
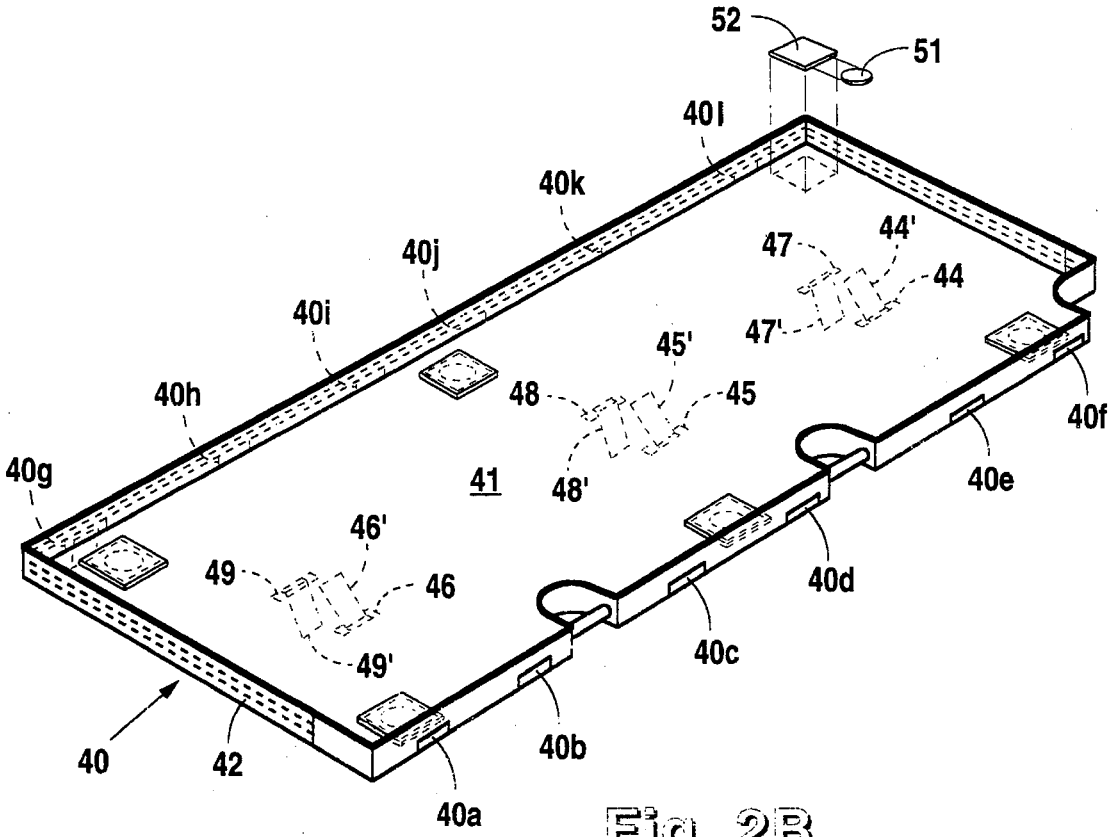
FIG. 2B shows an isometric perspective of the cover 40 of sub-mattress 34.

Referring to FIG. 2B, core 35 is removably enclosed within cover 40. Core 35 is removable to enable cleaning and (when necessary) replacement of core 35. The primary material of cover 40 in the preferred embodiment is a "Regency" fabric, which is laminated nylon taffeta fabric manufactured in China and distributed in U.S.A. by John C. Tucker Co., Inc. Cover 40 is made from such fabric and other components (described below) using conventional sewing techniques, such as outlined in FIGS. 3A–3D. Cut-outs 36 and 37 are generally semicircular in the plan view, and cut-out 38 is likewise sculpted using a circular arc in the preferred embodiment, all with vertical axes to enable vertical passage of hoses 151–153 therethrough, respectively.

Figure 3A:
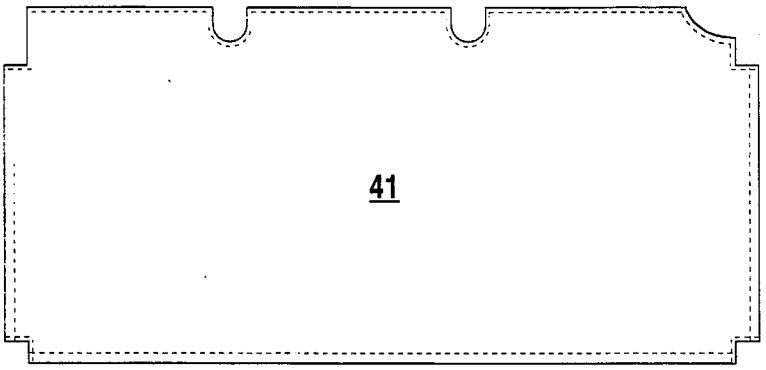
FIGS. 3A–3D illustrate the parts and manufacturing process for sub-mattress 50.
Figure 3B:
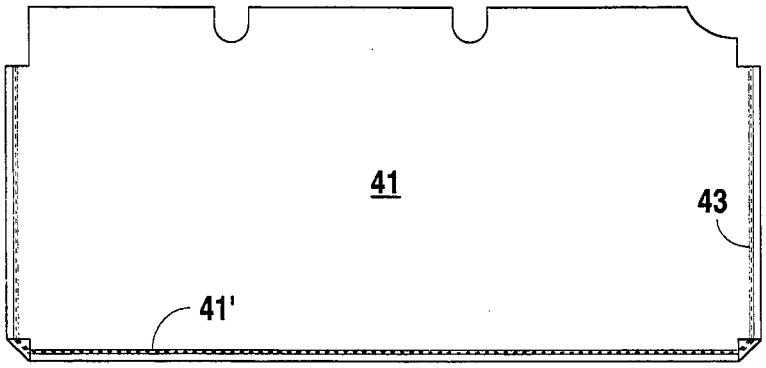
Figure 3C:
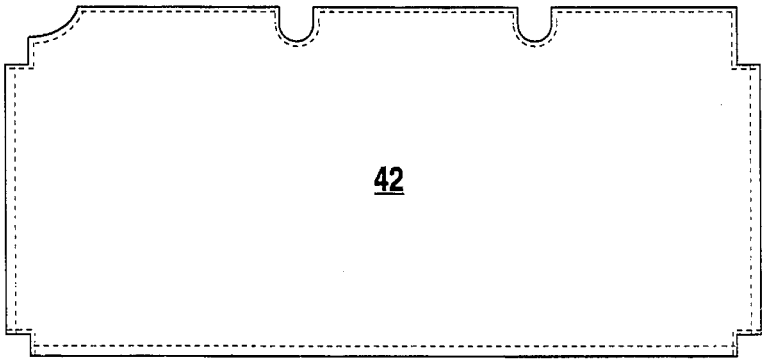

Referring briefly to FIGS. 3A–3D, to form cover 40 a first sheet 41 of Regency material is first cut as shown in FIG. 3A, with the laminated side facing up. Fold lines as shown in FIG. 3A are then marked on the material and seams are sewn at each of corners A–B and C–D. Referring further to FIG. 3B, the material is then folded along the fold lines marked in FIG. 3A and a seam is provided in a U-shaped path from the corner H through corner A–B, corner C–D and on to corner M. A male zipper 41' is then sewn along the U-shaped path on the inside edge of the folded material, as shown is FIG. 3B.

Figure 3D:
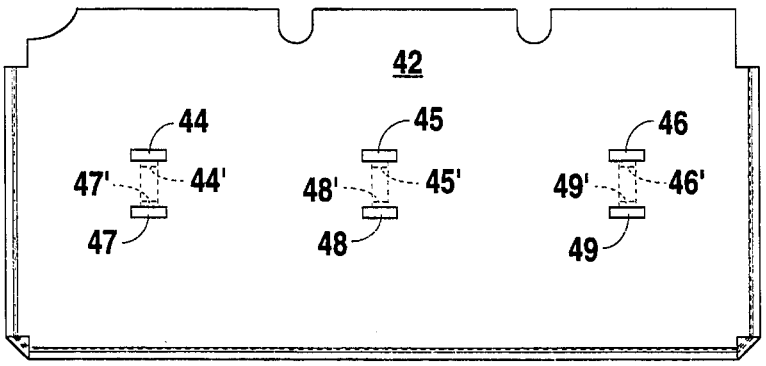

Similarly, a second sheet 42 of Regency material (shown in FIGS. 3C and 3D) is cut and sewn, and a female zipper 42' is sewn on its similar U-shaped seam from corner P to corner O–N, corner Z-Y and on to corner X (all shown in FIG. 3D). Six pieces of one-inch wide reinforcement strips 44–49 are then sewn to the laminated side of sheet 42. The reinforcement strips 44–49 in the preferred embodiment are of common webbing material which is more durable than the Regency fabric. Strips 44–49 are sewn to the inside surface of cover 40 (i.e., to the laminated side of sheet 42) to serve as doublers. Strips 44'–46' of Velcro loop material are then sewn to the outer surface of sheet 42 at the same location as reinforcement strips 44–46, and mating strips 41'–49' of Velcro hook material are sewn to the opposite reinforcement strips 47–49. This mating Velcro hook and loop arrangement is provided to help secure said mattress 34 to the metal pan surfaces 21*a–c* of frame assembly 20 in the preferred embodiment. More particularly with reference to FIG. 13, such a securing is enabled by the pairs of parallel slots 22*a–c* and 23*a–c* provided in the corresponding pan surfaces 21*a–c*. As will be evident, slots 22*a–c* are positioned to receive and correspond with Velcro loop material 44'–46', and slots 23*a–c* with Velcro hook material 47'–49', when sub-mattress 34 is properly placed and oriented atop pan surfaces 21*a–c*. Once so received through slots 22*a–c* and 23*a–c*, the mating pairs of strips 44'–49' are releasably secured to one another on the underside of pan surfaces 21*a–c*, thereby releasably securing sub-mattress 34 atop frame assembly 20.

Finally, strips 40*a–*40*l* of Velcro hook material are also provided along each lateral side of cover 40 to help secure cushions 31–33 in their preferred positions atop sub-mattress 34. The mating loop components of such Velcro strips 40*a–*40*l* are secured along both sides of each air cushion 31–33. Cushion 33, for instance, has four elastic straps 63–66 (FIG. 5C) with Velcro loop components 63'–66' sewn thereon for releasably mating with hook strips 40*l*, 40*k*, 40*e* and 40*f*, respectively, thereby securing cushion 33 to sub-mattress 34. Referring to FIG. 2B, a plurality of circular magnets 51 are also secured to the inside surface of the lower sheet 42 of sub-mattress 40. In the preferred embodiment, six such magnets 51 are secured to the lower sheet 42 spaced around its perimeter as shown. The primary purpose of such magnets 51 is to enable a grip-like engagement between sheet 42 and the pan surfaces 21*a–*21*c*, due to the metal nature of pan surface 21*a–*21*c*. Magnets 51 are secured to lower sheet 42 by means of fabric envelopes 52 which are folded around magnets 51 and then sewn to the inside of lower sheet 42.

Figure 4:
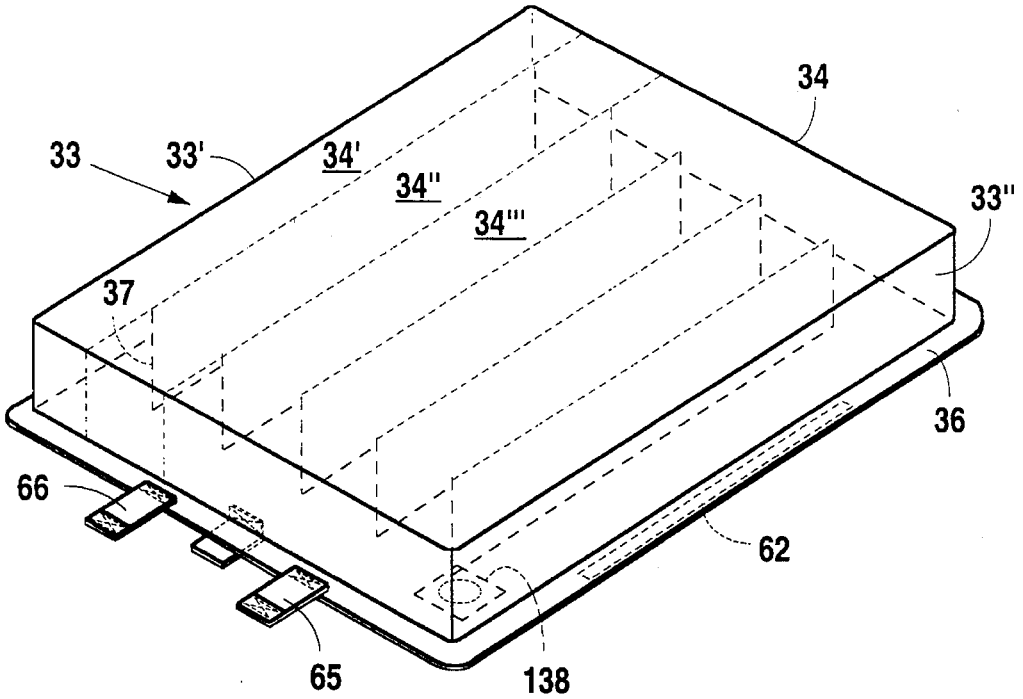
FIG. 4 shows an isometric perspective of cushion 33.

Referring to FIG. 4, there is shown a more detailed isometric perspective view of air cushion 33, which is identical to cushions 31 and 32. In the preferred embodiment of the present invention, each of air cushions 31–33 may be separately replaced, handled and/or cleaned. The separable nature of cushions 31–33 is beneficial for disinfection because it allows more thorough cleaning as well as selective cleaning which may help prolong the life of mattress 50 as a whole. In addition, if one cushion section fails it can easily be replaced by another interchangeable cushion saving the costs and inconvenience of replacing a complete mattress. Many other advantages of the separable structure of mattress 50 will be evident to those of ordinary skill in the art.

Much like air cushions 121–123 of said co-pending application Ser. No. 07/714,379, now U.S. Pat. No. 5,168,589, cushion 33 is provided with an upper patient surface 34' having differing permeability along its length ("length" referring to the dimension which is coincident with the length of mattress assembly 50 as a whole). The specification of the said co-pending application is incorporated herein in its entirety by this reference thereto. The upper surface 34 of cushion 33, more particularly, has a single, transversely oriented panel 34" formed of high-air-loss material, whereas panels 34' and 34''' are formed of low-air-loss material. Hence, cushion 33 is provided with a tranversely-oriented high-air-loss band 34" nearer to one of its longitudinal ends 33' than the other 33". Because the cushions 31–33 are identical and hence interchangeable, the cushions 31–33 can be positioned relative to one another in the manner most desirable for particular patient placement such that greater air loss occurs where desired. Particularly if the cushions 31–33 are adapted to be reversible (described further herein), a health care provider can thus concentrate air flow and/or heating in areas of greater concern and/or desire on the patient. A low-air-loss cover sheet (of same construction as high-air-loss sheet 11) can be used instead of sheet 11 in order to decrease air flow directly across the patient while maintaining the option of heating the patient.

Figure 5A:
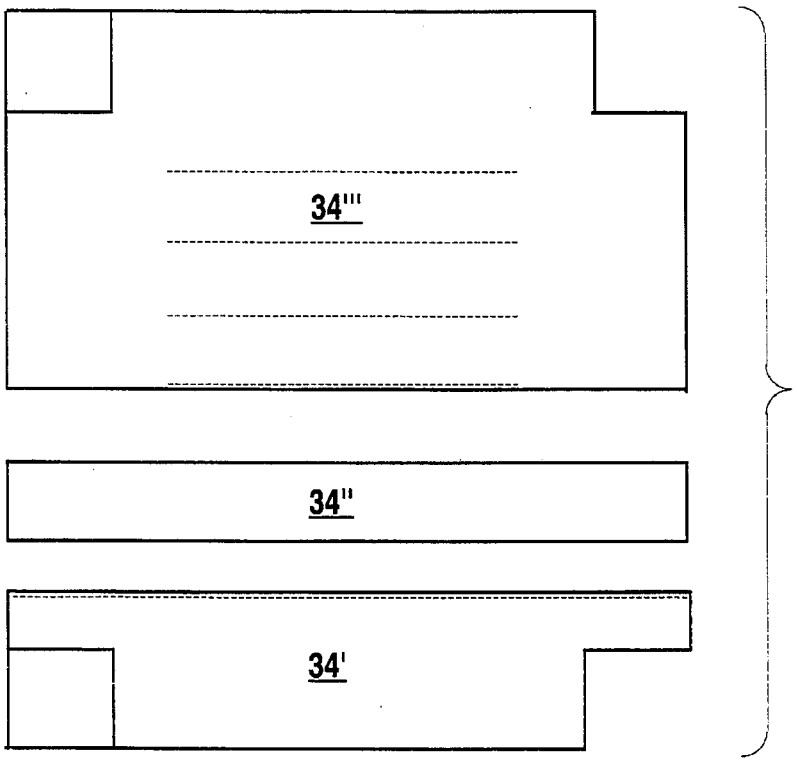
FIGS. 5A–5C are plan views showing various stages in fabrication of cushion 33.
Figure 5B:
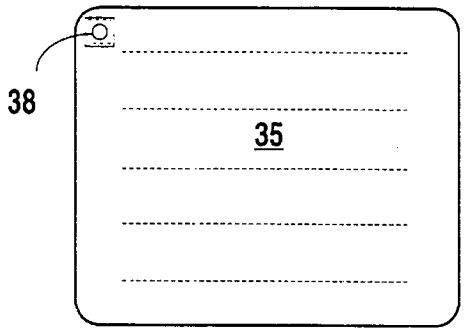

An exploded view of upper sheet 34 is shown in FIG. 5A to demonstrate the preferred dimensions. As shown, sheet 34 is actually formed of three panels 34', 34" and 34''', which are sewn together at their edges to form sheet 34, with dimensions as shown. Upper sheet 34 is then sewn to lower sheet 35 along each of their perimeters using conventional sewing techniques and adding a single strip of 1½ inch piping 36 (shown in FIG. 4). Piping 36 is integrated with cushion 33 around the perimeter of lower sheet 35 at the juncture between upper sheet 34 and lower sheet 35. Before finishing the sewing of sheet 34 to sheet 35, five identical baffles 37 (shown in hidden line) are also stitched in a parallel arrangement between the upper and lower sheets 34 and 35. Each of baffles 37 is a fabric panel formed of low-air-loss K-Kote® material in the preferred embodiment. Each of baffles 37 are roughly six inches high by twenty six inches long and serve primarily to prevent billowing of cushions 31–33, thereby ensuring a relatively flat patient support surface atop cushions 31–33. In fact, all surfaces of cushions 31–33 in the preferred embodiment are made of K-Kote® fabric, a polyurethane-backed nylon fabric except for panel 34", which is a special strip of GoreTex® high-air-loss fabric for facilitating greater localized air flow.

Figure 7A:
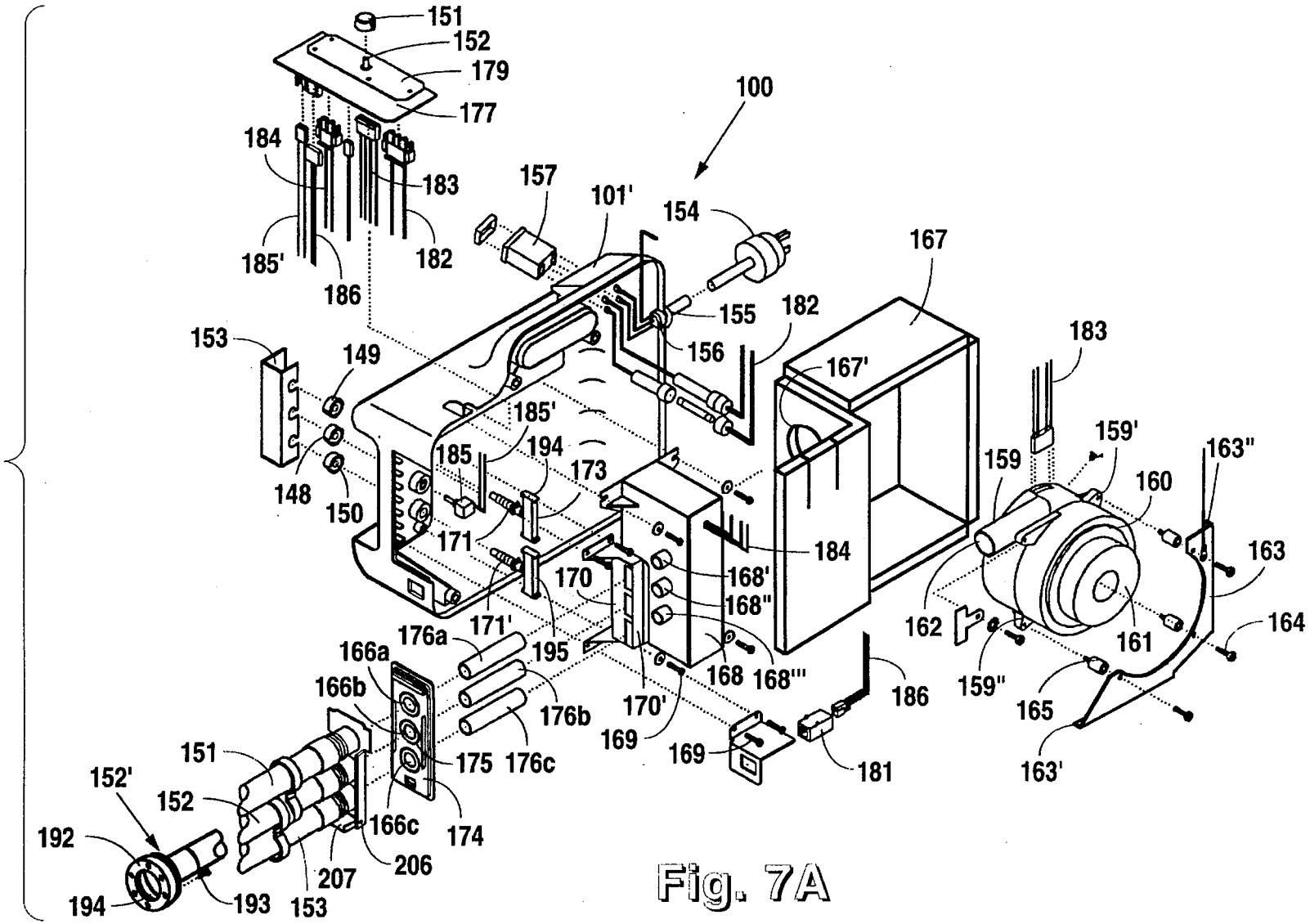
FIGS. 7A–C show exploded perspective of air supply unit 100.

Also prior to enclosing cushion 33, nipple 138 is secured to lower sheet 35 to provide an air inlet therethrough. Nipple 138 in the preferred embodiment is substantially identical to the male member of the air cushion connector shown as nipple 23 in FIG. 5B of, and otherwise described and claimed in, Applicant's U.S. Pat. No. 5,062,171, dated Nov. 5, 1991. As such, nipple 138 is preferably made of a resilient polymeric plastic material and is adapted with a radially extending tab 138 for releasably securing nipple 138 in operative engagement with the end 152' of hose 152. The ends 151'–153' of hoses 151–153 are appropriately adapted to releasably receive each of the nipples 138 of cushions 31–33. Referring for instance to FIG. 7A in conjunction with FIG. 5D, end 152 is provided with an integral retainer 192 having hole 194 centrally therethrough. Hole 194 is shaped relative to nipple 138 such that nipple 138 and its tab 138' can be inserted therein. Once inserted, nipple 138 is then rotated relative to retainer 192 (or vice versa) such that tab 138' is captured behind (or within) retainer 192, thereby preventing removal of nipple 138 until it is again properly aligned with hole 194 for removal. A screw 193 or the like may be employed to fix the rotation of nipple 138 relative to retainer 192 and thereby prevent inadvertent disconnection of nipple 138 from hose 152.

Figure 5C:
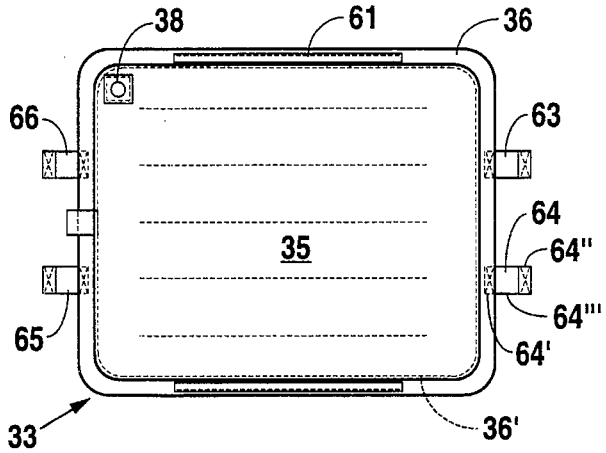
Figure 5D:
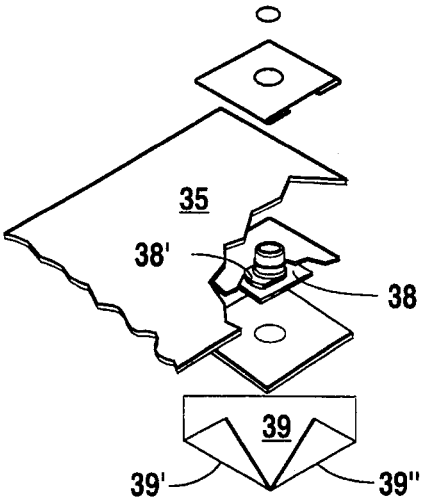
FIG. 5D shows an exploded, isometric perspective of nipple 138 and the manner of connection with cushion 33.
Figure 6:
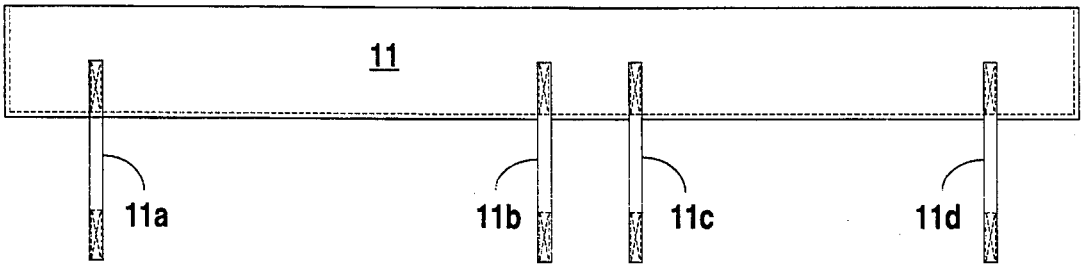
FIG. 6 shows an elevation view of cover sheet 11.

Referring to the exploded view of FIG. 5D, nipple 138 is secured through lower sheet 35 using known techniques, except a permeable deflector membrane 39 is secured in the manner shown in FIG. 5D along its edges 39' and 39". Membrane 39 in the preferred embodiment is a six-inch by six-inch square piece of permeable (37 micron) filter cloth which serves to deflect air toward the center of cushion 33 upon entry therein, despite the location of nipple 38 in the corner of cushion 33. Many benefits of this will be evident to those of skill in the art. One notable benefit is that the deflector 39 enables better distribution of air within cushion 33 and, thus, more evenly distributed temperatures both within and on the upper surface 34 of cushion 33. Ensuring such temperature distribution may be particularly beneficial, when the air entering nipple 138 is preheated for patient comfort or therapy. The permeability of deflector 39 enables air to escape cushion 33 through nipple 138 when the air supply unit 100 is turned off, a feature that may be useful to facilitate CPR procedures.

The upper and lower sheets 34 and 35 are sewn together (with piping 36 therebetween) around their perimeter to enclose an airtight inflatable chamber with a single fluid opening through nipple 138. The resulting cushion is a relatively flat cushion having a vertical height of between six and seven inches when inflated without supporting a load. In the sewing process, piping 36 is sewn to cushion 33 around its perimeter, at the seam 36' which joins upper and lower sheets 34 and 35. Zippers 61 and 62 (or the equivalent) are then sewn to piping 36 along each of the opposite longitudinal ends 33' and 33" of cushion 33. In use, zippers 61 and 62 serve to releasably join one cushion to the next, such as cushion 32 to cushion 33, in order to position the cushions 31–33 and form an integral air mattress with separable parts 31–33. When washing, zipper 61 can be joined to zipper 62 of the same cushion 33 to minimize wear of the cushions 31–33 and their zippers 61 and 62.

To enable customized repositioning of the high-air-loss panels 34" along the overall length of a patient, each of the zippers 61 and 62 are actually two zippers (or the equivalent)—one male and one female—sewn along side each other. This alternative of providing two zippers at each end of one of the cushions 31–33 enables reversal (or turning) of that cushion to change which end 10' or 10" its high-air-loss band 34" is nearer, all without affecting the other cushions 31–33.

Referring to FIG. 5C, four identical elastic Velcro securing straps 63–66 are sewn to piping 36. Each such elastic Velcro strap (referring to strap 64 specifically) comprises a tab 64" of Velcro loop material and a roughly five inch elastic strap 64'''. Strap 64" is sewn to piping 36 at it proximal end 64', and tab 64" is sewn to the distal end of strap 64'''.

An air-permeable cover sheet 11 (shown in FIG. 6) is also preferred for covering cushions 31–33 as well as sub-mattress 34. In the preferred embodiment, cover sheet 11 is a fitted, low-friction, low-shear, high-air-loss GoreTex® cover sheet, although a K-Kote® sheet or standard hospital bed linen is also suitable in many cases. A total of eight Velcro straps **11*a–d* are provided to help secure the cover sheet 11 to the frame assembly 20 of the preferred embodiment—four straps 11*a–d* spaced along each side of sheet 11. Straps 11*a–d* are substantially in elastic,with mating Velcro hook and loop tabs sewn to their opposite ends. Each of straps 11*a–d* are sewn to the cover sheet 11 with Velcro loops on their proximal end and Velcro hooks on their distal end, so that the distal end of each said strap 11*a–d* can be inserted through a corresponding anchor slot and then releasably secured back to its own proximal end, as is conventional in the art. With cross-reference to FIG. 13, straps 11*a–d* are specifically secured through anchor slots 24*a–d* (respectively), and the four opposite anchoring straps of cover sheet 11 (not shown in FIG. 6) are secured through anchor slots 25*a–d*** in the preferred embodiment.

Figure 14:
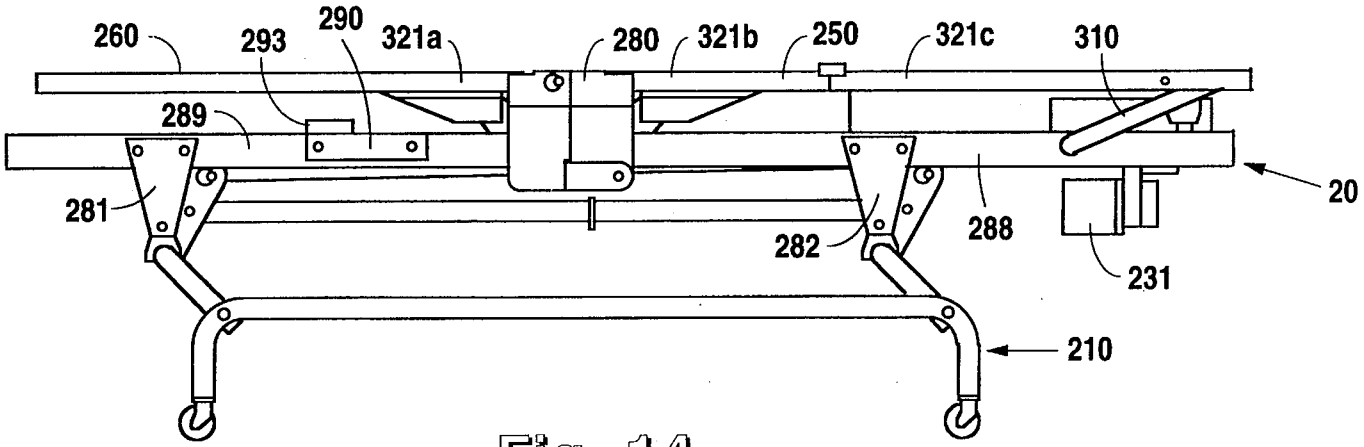
Figure 14G:
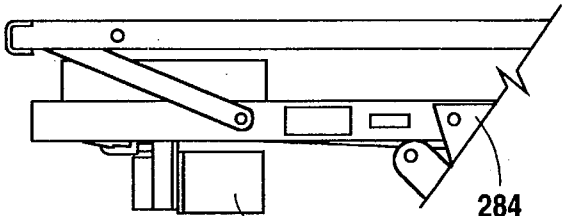
Figure 14B:
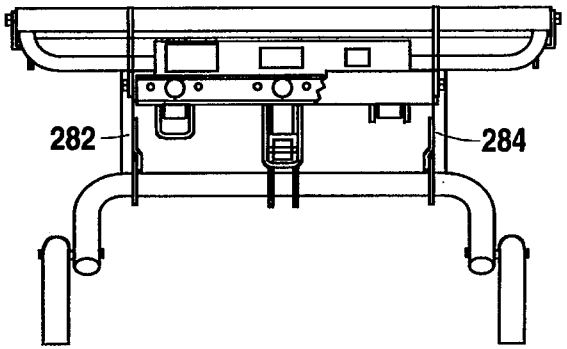
Figure 14A:
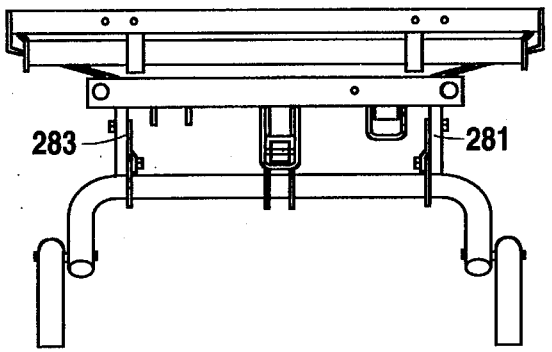
Figure 15:
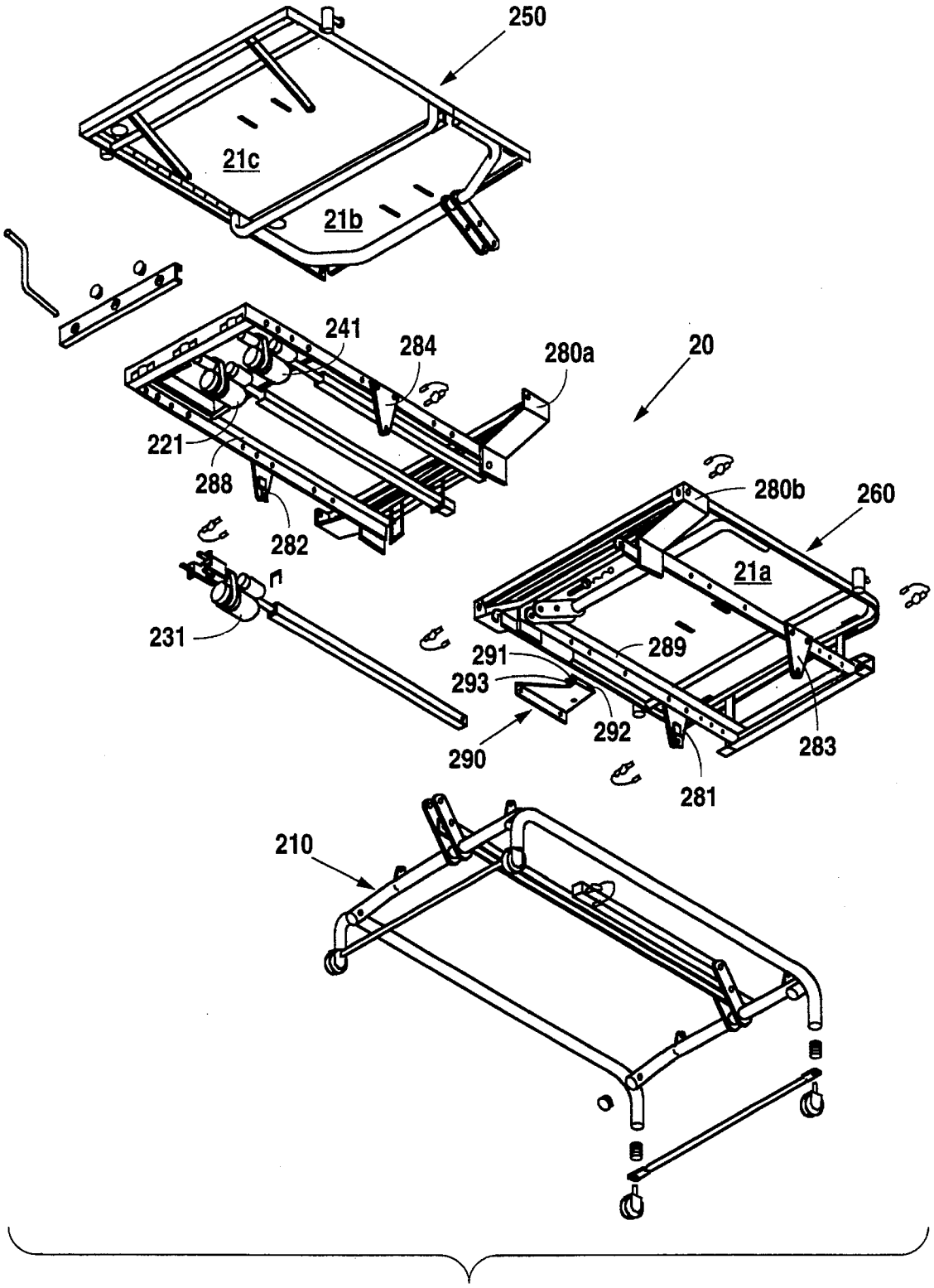

Referring to FIGS. 1–8, air flow into each of air cushions 31–33 is provided by air supply unit 100 located near the head end 10' of the bed 10. Unit 100 is removably mounted to the frame assembly 20 beneath its pan surface **21*a* by means of a mounting bracket 290 (FIGS. 14 & 15). Referring briefly to FIG. 15, bracket 290 is preferably a simple bracket rigidly connected to a non-articulating strut 298 of frame assembly 20. Bracket 290 has two upwardly extending flanges 292–293 defining an upwardly-facing channel 291 for receiving handle 101*a* of housing 101. Thus, unit 100 may be mounted beneath mattress assembly 50 and pan surface 21*a* by hanging unit 100 on bracket 290. As an alternative, the same structure allows the unit 100 to be set on the floor beneath bed 10**.

Figure 13:
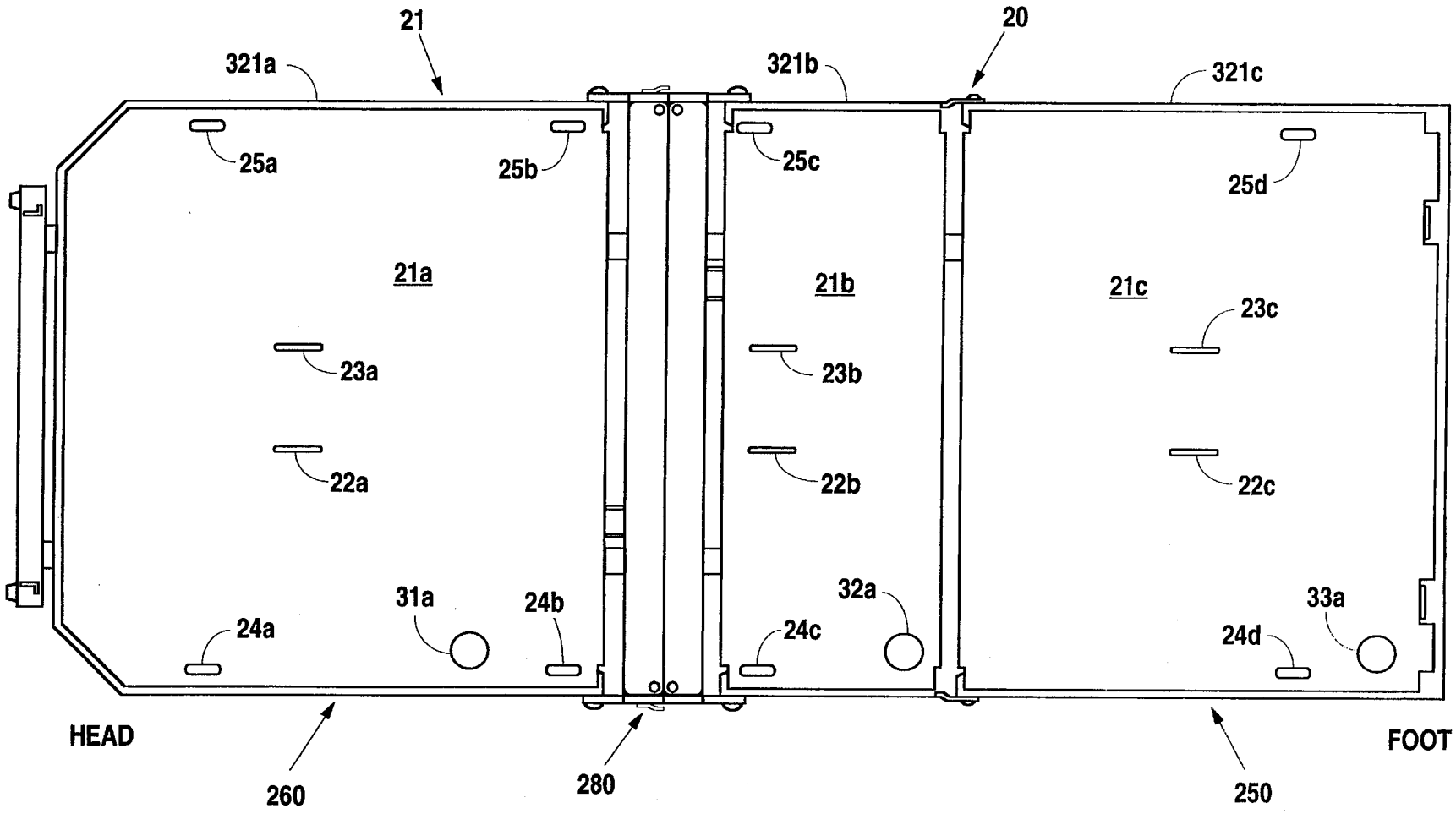
FIGS. 13–15 show frame assembly 20 in a form easily understood.

Air hoses 151–153 extend from the air supply unit 100 through respective holes **31*a*, 32*a* and 33*a* to each of the three air cushions 31–33. Holes 31*a*, 32*a*, and 33*a* are preferably circular holes positioned as illustrated in FIG. 13 to enable the extension of the air hoses 151–153 through pan surface 21. Potential noise and structural nuisances of bed 10 are minimized by mounting the air supply unit 100 beneath mattress assembly 50 and routing hoses 151–153 from unit 100 vertically through the supportive pan surfaces 21*a–c* and sub-mattress 34 into the corners of cushions 31–33. At unit 100, hoses 151–153 are connected with a quick release hose coupler 206 (FIGS. 7A and 8) in the same fashion as with Applicant's commercially available "First Step Plus" product, as described in the said co-pending application Ser. No. 07/714,379, now U.S. Pat. No. 5,168,589. Such a connection provides for normally sealed fluid connections between valve tubes 176*a–c* and hoses 151–153 through ports 166*a–c* (respectively) in air outlet panel 174 of unit 100. When desired, the hoses 151–153 can then be quickly disconnected from unit 100 by operation of quick release lever 207. The air pressure within the cushions 31–33 can be adjusted to accommodate each patient's body shape and weight with three air flow adjustment knobs 148–150 located on the face of the air supply unit 100**.

Figure 8:
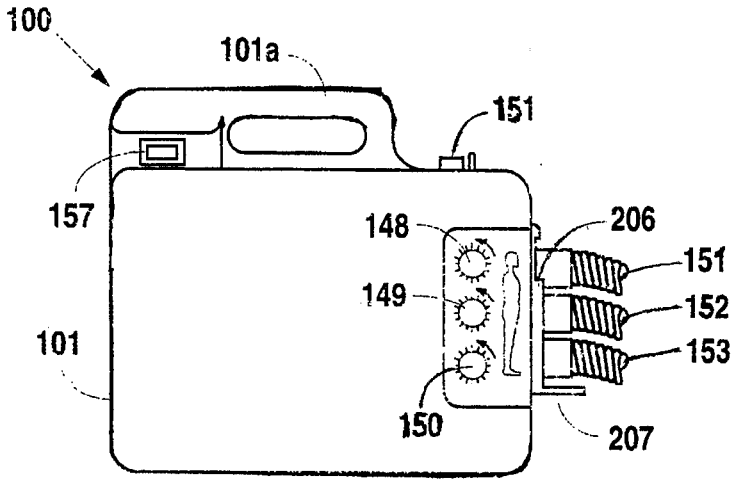
FIG. 8 shows a frontal view of the air supply unit 100.
Figure 7B:
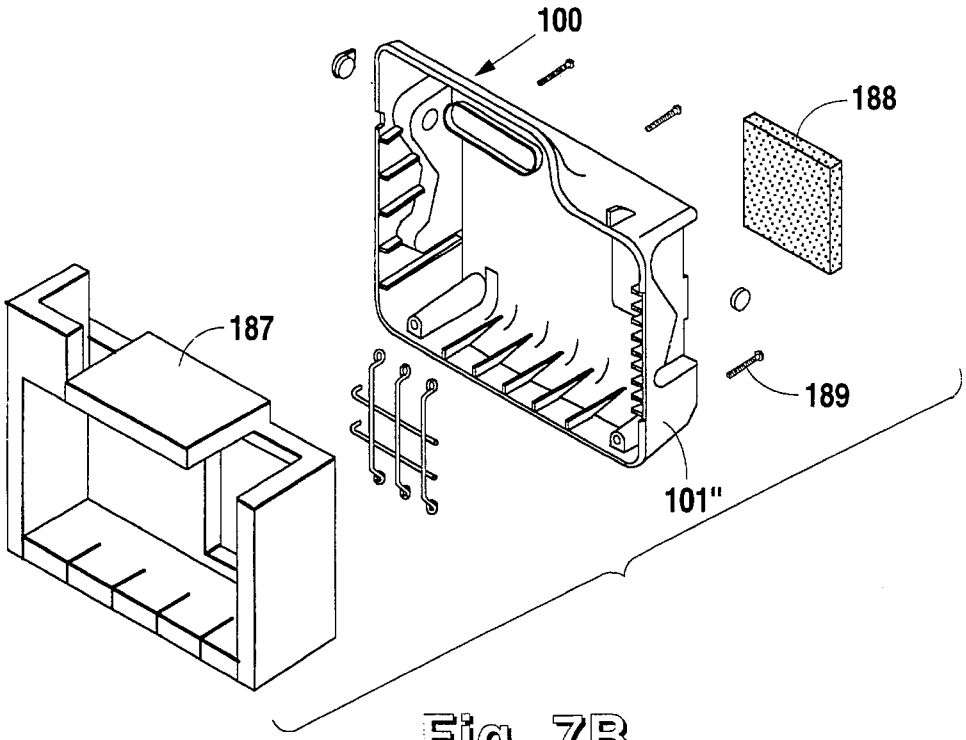

Referring to FIG. 7A, there is shown an exploded view of the air supply unit 100 without the components shown in FIG. 7B. FIG. 7B shows the remaining components of air supply unit 100 in a similarly exploded view. Referring to FIGS. 7A–8, air supply unit 100 basically comprises a housing 101, a blower 159, a manifold assembly 168, air valve tubes 176*a–c* and related components which make up valves for controlling flow through the valve tubes 176*a–c*, a potentiometer 185, power switch 157 and its related components, power cord 154, and controller 177. Housing 101 basically has a front half 101' and a back half 101", secured together by connecting screws 189 The blower 159 is a conventional blower manufactured by Ametek-Lamb in the preferred embodiment. For minimizing noise, a blower damping disk 160 and a blower acoustical foam donut 161 are adhesively bonded to blower 159. In addition, blower 159 is surrounded by an acoustical foam enclosure comprising elements 167 (FIG. 7A) and 187 (FIG. 7B). Blower unit 159 is secured by means of rubber-like connectors 165 which further isolate and reduce blower vibration and related noise. Connectors 165 themselves are threadably or adhesively secured to mounting ears 150 formed integral with blower 159, and corresponding screws 164 threadably secure connectors 165 to blower mounting bracket 163. The blower mounting bracket 163 is then firmly secured to the interior walls of front housing half 101', preferably by trapping flanges 163' and 163" along the edges of bracket 163 in a captive groove that is formed by joining halves 101' and 101" of housing 101.

A control cable 183 is electrically connected to blower 159 for controlling the operation thereof based on power distributed and controlled by controller 177. The pressure outlet 162 of blower 159 is connected through hole 167' of acoustical insulation 167 into sealed engagement with an inlet opening 268 in manifold assembly 168. Such sealed engagement is aided by grommet 268*a* in a conventional manner. Air flows freely from the inlet 268 of manifold assembly 168 to each of its outlets 168', 168" and 168'" so that the pressure at each of those outlets is essentially the same. A heating element (described further herein) is provided within manifold assembly 168 for uniformly warming air passing through assembly 168 between inlet 268 and each of outlets 168', 168" and 168'". Each of outlets 168'–168'" are connected in fluid communication with valve tubes 176*a–*176*c*, respectively, and thence, corresponding openings 166*a–*166*c* in air outlet panel 174. Chassis 170 is secured to housing 101 between the manifold assembly 168 and outlet panel 174 to help maintain positioning of valve tubes 176*a–c* while also ensuring proper operation of the corresponding valves. Valve tube 176*b* is in free, unrestricted communication with outlet 166*b*, whereas each of the valve tubes 176*a–*176*c* are associated with valves 194 and 195, respectively, for enabling adjustable restriction of the flow therethrough.

The said adjustable restriction effected by valves 194 and 195 is determined based on the adjustments of rotary knobs 148 and 150, which in turn determine the degree which valves 194 and 195 squeeze (and therefore restrict flow through) valve tubes 176*a* and 176*c*. Valves 194 and 195 are identical and are of relatively simple construction. Valve 194, for instance, comprises a valve stem 171 which supports and positions a valve swivel foot 173 in spaced relationship with an opposing wall 170' of chassis 170 for varying the degree of compression of valve tubes 176*a–*176*c*. Valve stems 171 and 171*a* are directly engaged with knobs 148 and 150 for enabling manual adjustment thereof.

Rather than variably restricting valve tube 176*b*, one aspect of this invention involves controlling the flow therethrough by controlling the speed of blower 159. Rotary knob 149 is connected to potentiometer 185 for adjusting the same. Due to unit 100's control circuitry outlined below, adjustment of potentiometer 185, in turn, adjusts the speed of blower 159. The potentiometer cable 185' electrically links with controller 177 to contribute to the overall operation of air supply unit 100. Hence, because tube 176*b* is unrestricted, the flow therethrough is directly controlled based on the adjustment of knob 149. Although the body air flow adjustment knob 149 is provided primarily to control the BODY cushion 32, it still controls the blower speed for the whole bed (total air volume to all three cushions 31–33). Therefore, air flow to the BODY cushion 32 is dictated principally only by blower speed, while the HEAD and FEET air flow adjustment knobs 148 and 150 throttle the air flow to achieve the desired pressures in cushions 31 and 33 for the head and feet (respectively) of a patient. The BODY cushion 32 is positioned to generally support the midsection and thus the seat and the greatest proportion of a patient's weight. The pressure control in this embodiment therefore incorporates an ideal system for minimizing bed 10's energy consumption while also simplifying the construction of air supply unit 100. An air flow control knob lock-out 153 may be provided to help prevent unauthorized access to and adjustment of knobs 148–150.

Figure 7C:
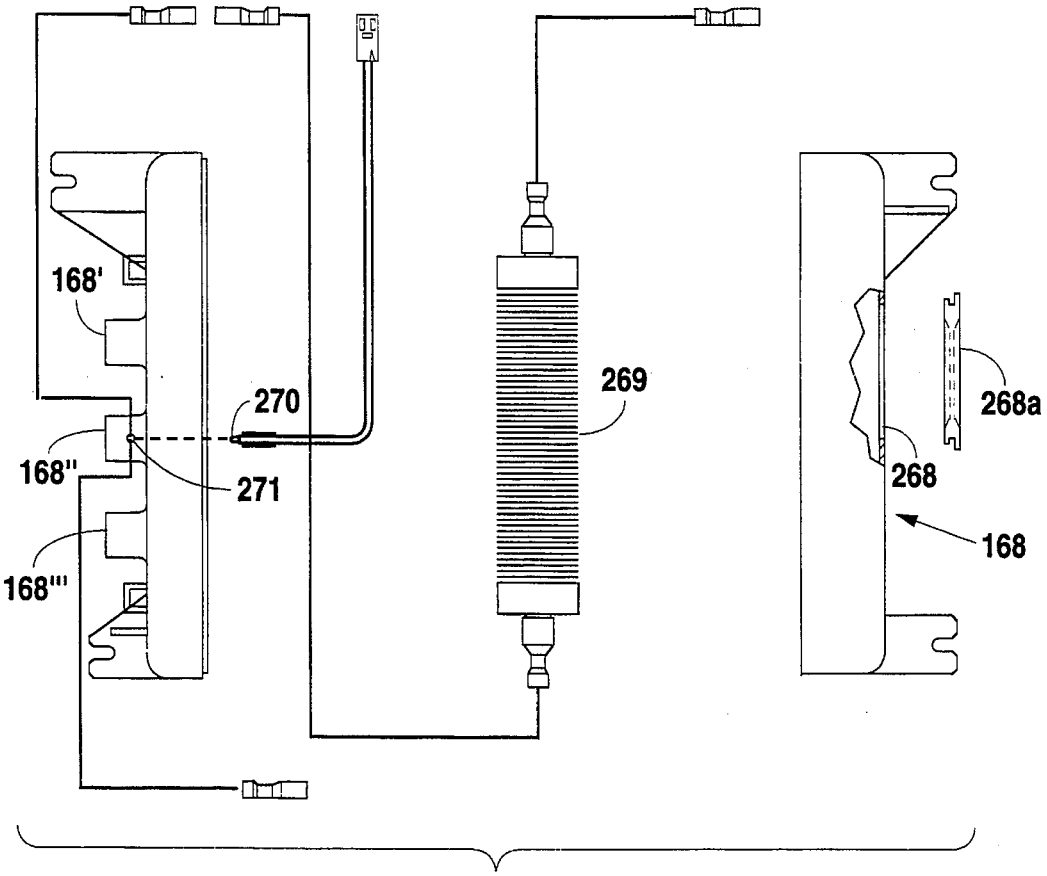

Heater control knob 151 is directly mounted to a rotary transducer 152 for adjusting the current to (and hence the temperature output of) a heater element 269 contained within manifold assembly 168. Referring to FIG. 7C, heater element 269 is a PTC element incorporated in manifold assembly 168 of air supply unit 100 for selectively raising temperature of the air directed into the cushions 31–33 up to approximately 8 to 10 degrees above ambient room temperature. A heater control knob 151 is located on the top of the air supply unit 100. A single temperature thermistor 270 is provided to help prevent excessive warming by heater element 269. Thermistor 270 is placed in an optimum location for preventing excessive warming by inserting it through a small hole 271 drilled into central outlet port 168", which tends to have the greatest air flow therethrough due to the valving arrangement described above. Thermister 270 is linked in the circuit for heater element 269 via cable 270' and controller 177, to interrupt operation of heater 269 if temperatures in port 168" exceed predetermined levels. A thermal fuse 272 (FIG. 9) is also provided in the heater cable 184 to interrupt operation of heater 269 in the case of over warming.

Manifold cable 184 is likewise connected between manifold 168 and controller 177. Power switch cable 182 is also linked to controller 177 to empower controller 177 when switch 157 is actuated and plug 154 is properly plugged into a conventional power outlet. Hand control cable 186 is connected to a six-pin phone jack 181 that is mounted beneath air outlet panel 174. Phone jack 181 enables expansion of the control capacity of air supply unit 100 by enabling the addition of hand control 200 as shown in FIGS. 9 and 11A–12C, which is linked to controller 177 within air supply unit 100 by means of electrical connection 186.

Figure 9:
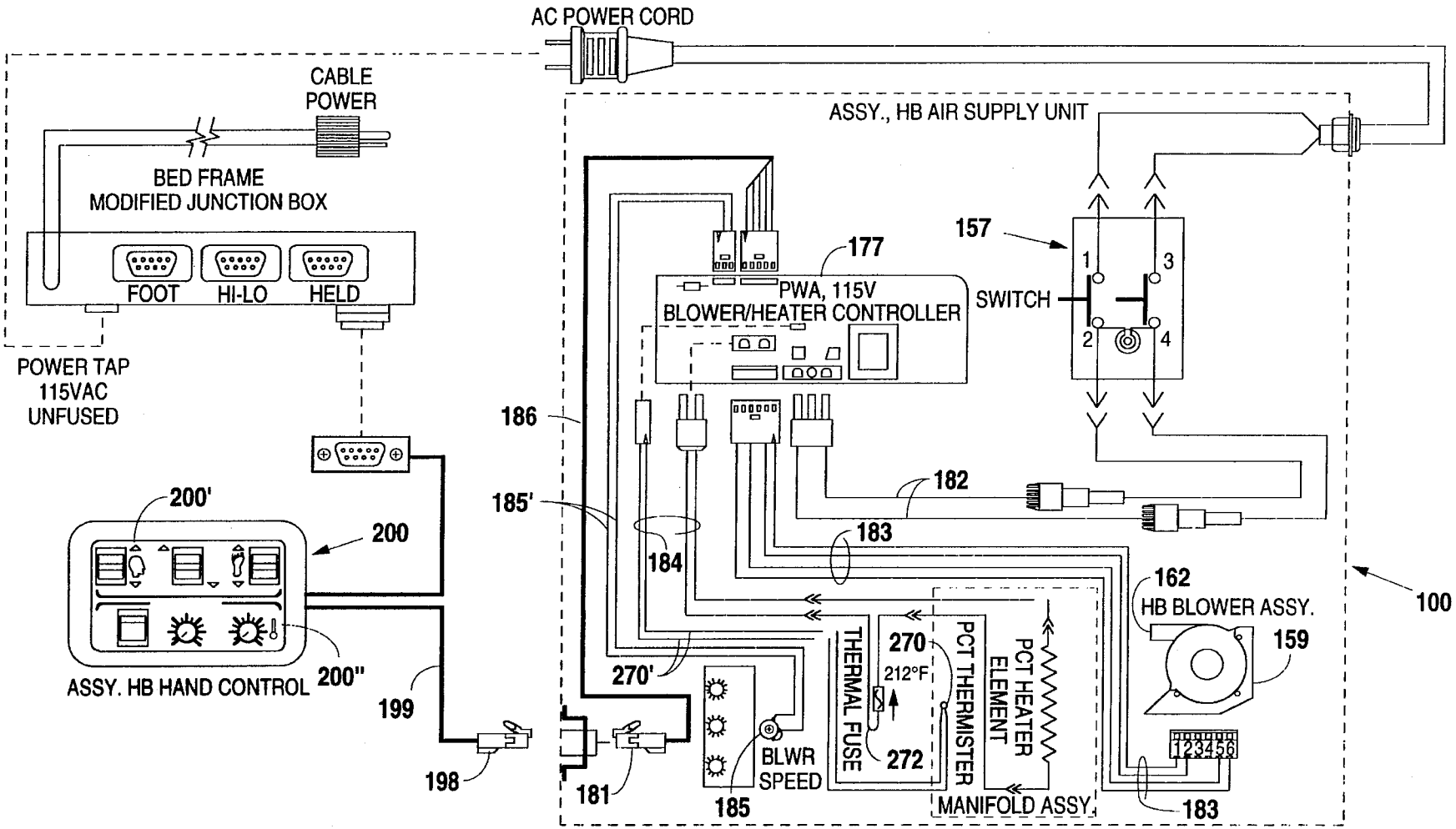
FIGS. 9 and 10 show a circuitry schematic for controller 177.

Referring to FIG. 7B, the remaining components of air supply unit 100 are readily apparent therein. Polyurethane foam insulation 187 helps to further reduce noise of the unit and air filter 188 is caged over an opening in the rear of housing shell 101" in the same manner as described in the disclosures of said co-pending application. Further understanding of the operation of the air supply unit 100 will be evident from an understanding of controller 177 and from a description of the use of hand control 200. Also for another view of many of the same components shown in FIGS. 7A and 7B, refer to FIGS. 9, 10, and 11A–11B. FIG. 9 shows the electrical schematics for each of the units, together with their interrelationship. The remaining aspects of blower unit 100 and its housing 101 will be readily apparent to those of ordinary skill in the art in view of the prior art and in view of Applicant's own co-pending patent application, Ser. Nos. 07/714,379, now U.S. Pat. No. 5,168,589, and 07/798,761, now U.S. Pat. No. D344735, filed Jun. 11 and Nov. 27, 1991.

Figure 14C:
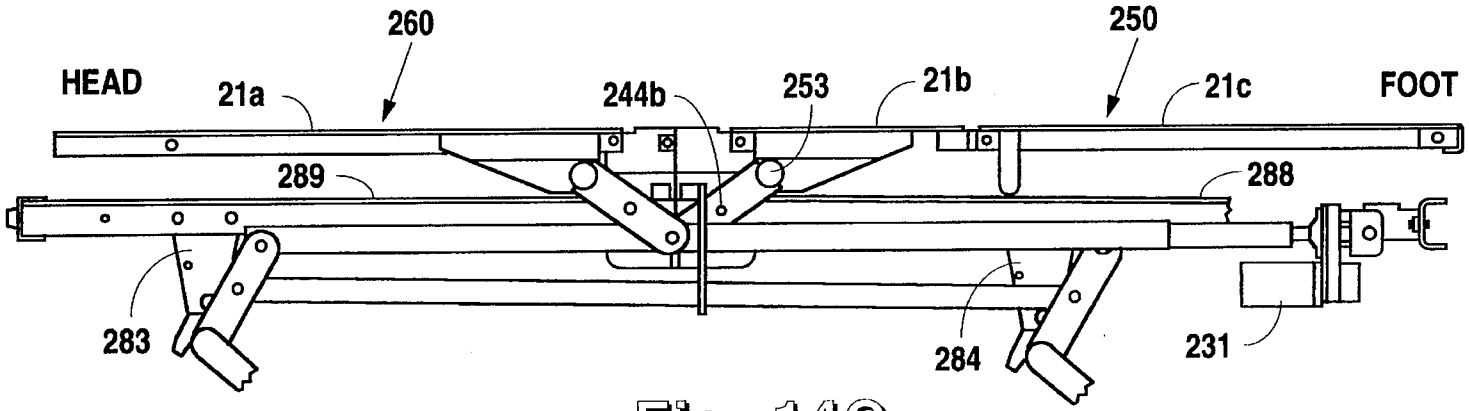
Figure 14E:
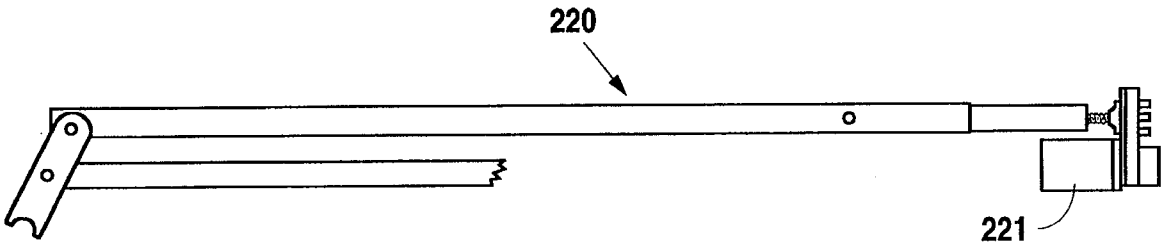
Figure 14D:
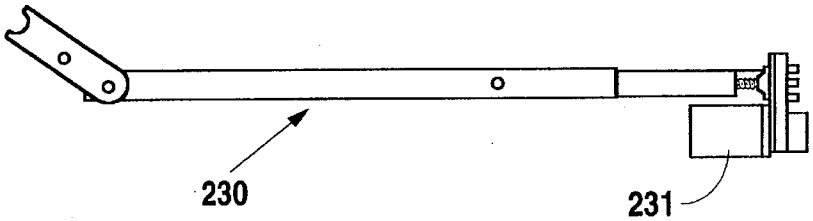
Figure 14F:
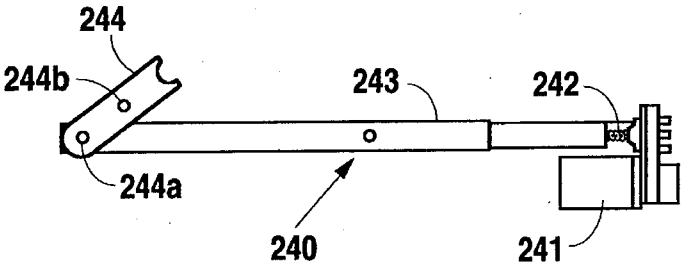

Frame assembly 20 in the preferred embodiment is a simple, lightweight frame assembly that can be easily disassembled for transport and reassembly through awkward hallways and the like. Except for pan surfaces 21*a–c* and bracket 290, which are special adaptations, the preferred frame 20 itself (or one substantially the same) is presently commercially available as an 82 inch model KB split-rail frame available through Simmons Healthcare of Norcross, Ga., (formerly Thill, Inc.) or its parent company, Basic American Medical Inc., which has offices in Indianapolis, Ind. and Oshkosh and Fond du Lac, Wisc. The structure and operation of frame assembly 20 will also be readily understood to those of ordinary skill in the field of hospital bed frames from a review of FIGS. 1 and 13–15. As shown therein, frame assembly 20 basically comprises a caster frame 210, a bed raise-and-lower system 220 (FIG. 14E), a head raise-and-lower system 230 (FIG. 14D), a foot raise-and-control system 240 (FIG. 14F), a foot assembly 250, a head assembly 260, a two-part hinge support 280, and support brackets 281–284 and other connecting members operatively uniting frame assembly 20.

With reference to FIG. 14, once fully assembled, the head assembly 260, foot assembly 250 and hinge support 280 are connected to one another such that certain members such as hinge support 280 and struts 288 and 289 are held in fixed relation to one another. Surface supports 321*a* and 321*b* are hinged to opposite ends of hinge support 280. One end of surface support 321*c* is hinged to the free end of support 321*b*, and the other end of support 321*c* is linked back to strut 288 by a diagonal link 310 which pivots at each of its ends. Operation of each of the raise-and-lower systems 220, 230 and 240 is conventional; for instance, with system 240, a motor 241 operates to turn a screw jack 242 ensleeved within a torque tube 243 to adjust the length of the torque tube 243. The torque tube 243 is pivotally hinged with a crank arm 244 by pin 244*a* at the distal end of tube 243, and the crank arm 244 is in turn rigidly connected (i.e., welded) to a transverse member 253 (FIG. 14C) that supports pan surface 21*b* and support 321*b*. The crank arm 244 is also pivotally mounted by a second pin 244*b* to a strut 288 whose position in relation to motor 241 is dictated by mechanical linkage therebetween. Thus, pan surface 21*b* and its support 321*b* are linked to motor 241 in a manner such that operation of motor 241 causes controlled movement of surface 21*b*. Similarly, pan surface 21*a* and its support 321*a* are linked to motor 231 by raise-and lower assembly 230 in a manner such that operation of motor 231 causes controlled movement of surface 21*a*, and struts 288 and 289 are linked to motor 221 in a manner such that operation of motor 221 causes controlled vertical movement of the entire head and foot assemblies 250 and 260 as well as hinge support 280. Further understanding of how to make and use frame assembly 20 will be evident in view of Exhibits A & B attached hereto and incorporated herein by this reference.

Pan surfaces 21*a–c* are formed as three independent hard pan surfaces which are then welded around their perimeter (or otherwise joined) to their respective supports 321*a–c* of frame assembly 20, as shown in FIGS. 13–15. Pan surfaces 21*a–c* have slots 22*a–c*, 23*a–c*, 24*a–d* and 25*a–d*, as well as holes 31*a*–33*a*, therethrough for accommodating hoses 151–153 and the various Velcro straps of mattress assembly 50. Slots 22*a–c* and 23*a–c* are particularly suited for securing mattress assembly 50 atop pan surfaces 21*a–c*, respectively.

The bed 10 is also provided with full-length siderails 70 and 71 that can be adjusted in height to help provide for the safety of the patient in a variety of bed positions. Each end of the siderail can be independently set in one of two elevations to accommodate bed positioning and desires.

Figure 12A:
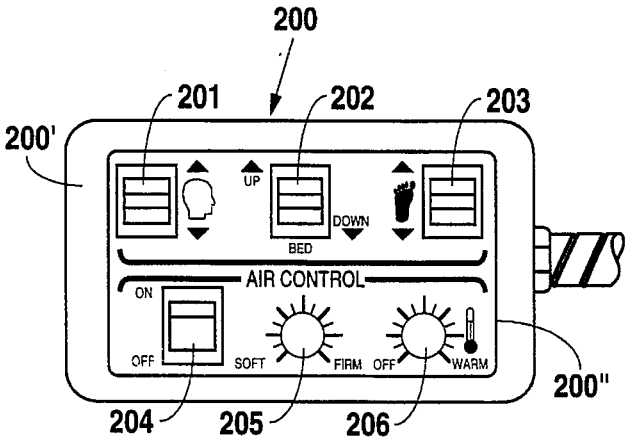
FIGS. 12A–C show the pendant hand control 200.

The pendant hand control 200 is designed for ease of operation by elderly patients and care givers. The hand control 200 functions of bed positioning, air flow and air temperature are labeled with large, color-coded, easily recognized graphics as shown in FIG. 12A. Large paddle and toggle switches 201–204 show clearly which position the controls are set in, and make manipulation of the switches 201–204 easy even for weak patients. In use, the hand control 200 allows limited patient modification of the air flow and air temperature settings, as well as full control of bed height and head and foot positioning. The hand control 200 is releasably mounted by means of Velcro strips in a bracket 271 (FIG. 1) on the side rail 71. If in the judgment of the patient's care giver, the patient should not be allowed access to the hand control 200, it can be mounted on the footboard 9*b* as shown in FIG. 1, out of the patient's line of sight. The hand control 200 can also be disconnected from the air supply unit 100, removing the capability of remote modification of the initial air flow settings on the air supply unit 100 as well as the ability to adjust bed positions. Hand control 200 is best understood by distinguishing the upper half 200' and lower half 200" thereof.

Figure 11A:
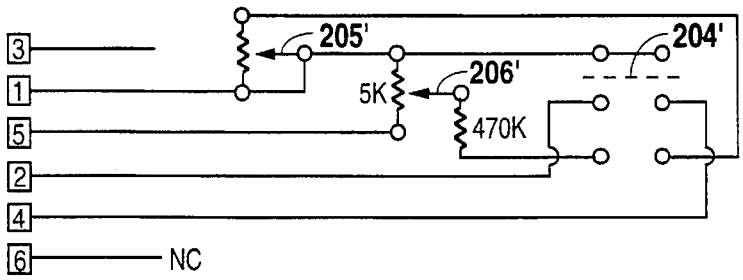
FIGS. 11A & 11B show a circuitry schematic for hand control 200.
Figure 11B:
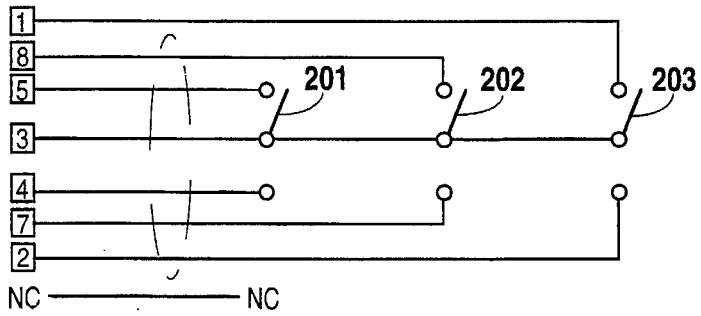

The upper half 200' of hand control 200 includes all of the conventional bed frame controls that are commonly found in hospital bed hand controls. For instance, with additional reference to FIGS. 12A–12C, a user of bed 10 would actuate toggle switch 201 to raise or lower the head section 260 of bed 10 (and thereby actuate motor 231 of frame assembly 20), would actuate toggle switch 202 in the "up" or "down" direction to raise or lower (respectively) the hinge support 280 and hence entire pan surface 21*a–c* (and thereby control motor 221 of frame assembly 20), and would actuate toggle switch 203 to raise or lower the foot section 250 of frame assembly 20 (and thereby actuate motor 241 of frame assembly 20). The circuitry corresponding to such functions of toggle switches 201–203 is shown in FIG. 11B. Such controls are the only bed electronic controls in the preferred embodiment, although manual adjustment of the bed 10's position is possible. To make control 200 the only such electronic control, the hand control 200 has been substituted for the normally available bed control that is standardly provided with bed frame assembly 20 by its manufacturer.

Referring however to the lower half 200" of hand control 200, a patient and/or care giver using hand control 200 may adjust the air supply features provided by air control unit 100. To best understand the interaction between hand control 200 and the controls which are integral with air supply unit 100 and frame 20, reference is made to the operations thereof. From those operations, those of ordinary skill in the art will readily understand how to make and use the invention as well as the preferred embodiments thereof. The effect of using the hand control 200 is dependent upon the setting on the air control unit 100 itself. For instance, if air supply unit 100 has been deactuated at switch 157 on the unit itself, the patient cannot then turn the air supply unit on from the hand control 200. On the other hand, if the power switch 157 is actuated on unit 100, the patient or care giver can then selectively actuate or deactuate the blower feature provided by air supply unit 100. In addition, the hand control potentiometers associated with knobs 205' and 206' effectively modify the settings of potentiometers 185 and 152' (shown in FIG. 10), thus modifying the blower speeds and the heating level as provided by air supply unit 100. The circuitry of controller 177 is represented schematically in FIG. 10.

Figure 10A:
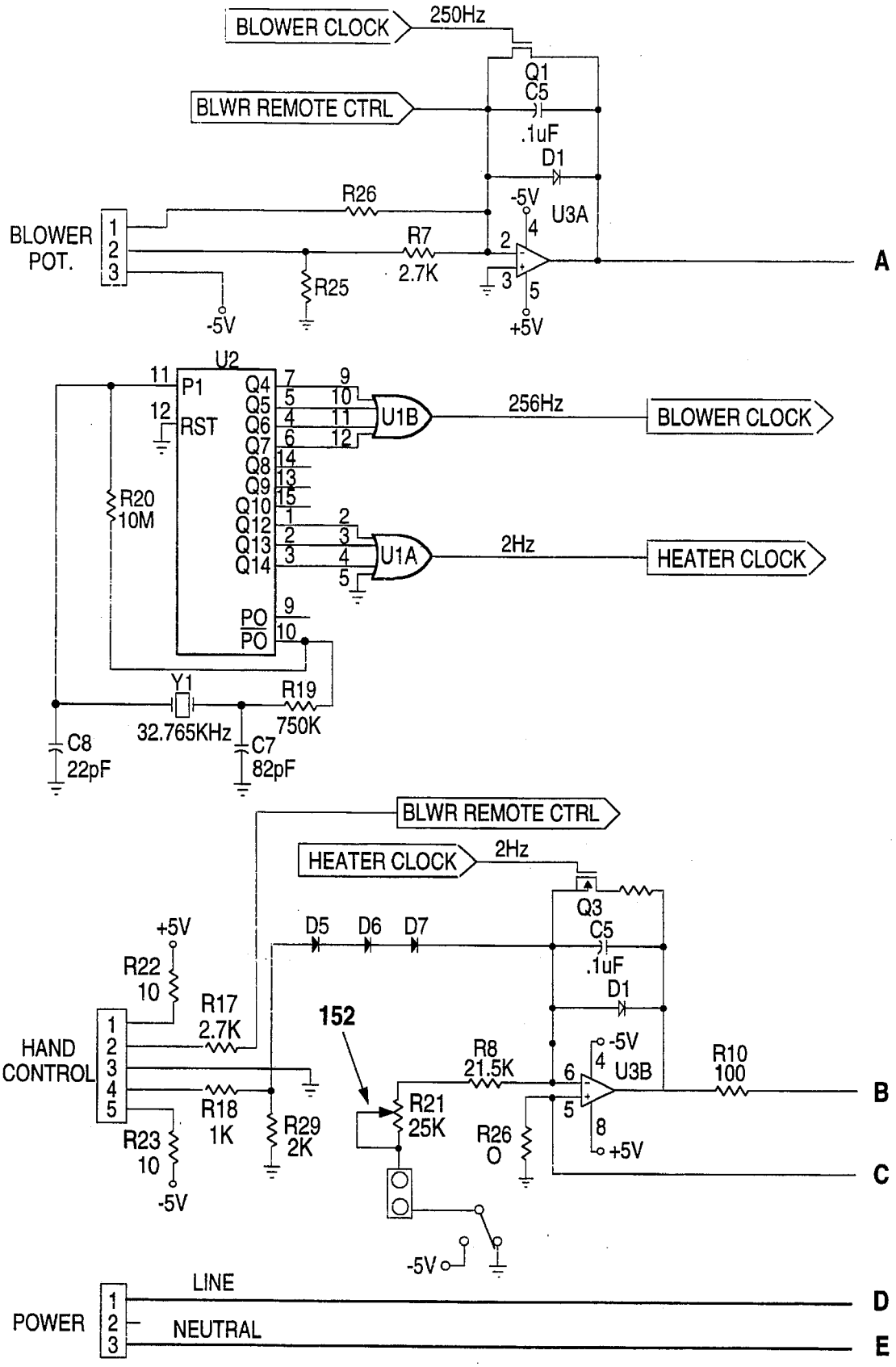
Figure 10B:
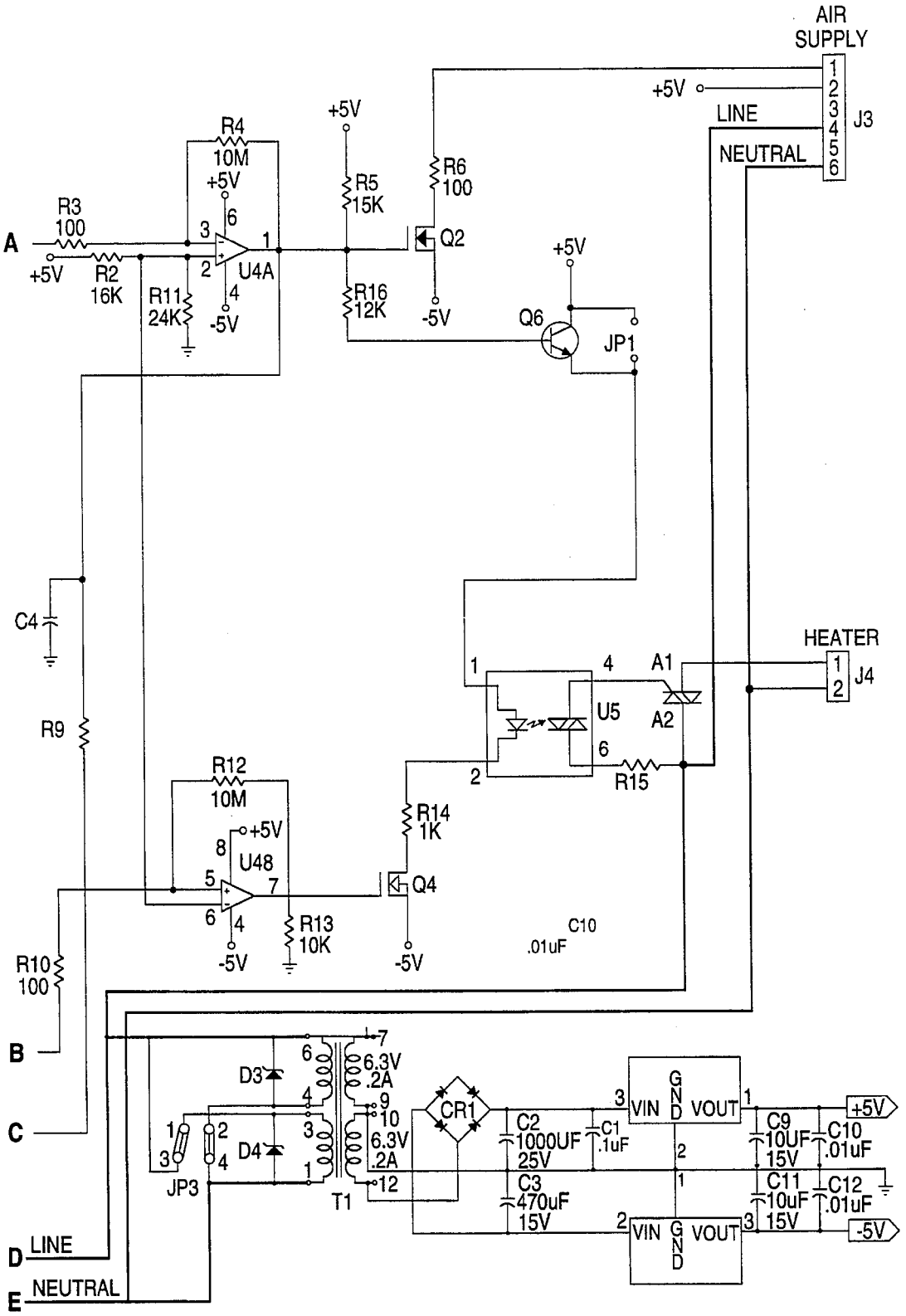

FIG. 10 shows the electrical schematic for the blower/heater controller 177 (shown in FIG. 9). To relate FIGS. 9 and 10, refer to the following common designations: J1, which is the outlet for cable 185' which communicates the setting of potentiometer 185 to controller 177; J2, which is the outlet for connection of cable 186 which links controller 177 to hand control 200; J3, which is the outlet for connection of cable 183 to controller 177 for enabling electrical communication and power transmission to blower assembly 159; J4, which is the outlet for providing power transmission to heater element 269; J5, which is the outlet of controller 177 for receiving power from power switch 157 via line 182. The remainder of FIG. 10 will be readily understood by those of ordinary skill in the art in view of comparisons with other figures and functions of the preferred embodiment.

Figure 12B:
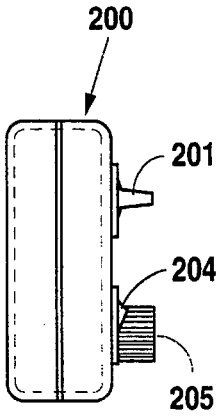
Figure 12C:
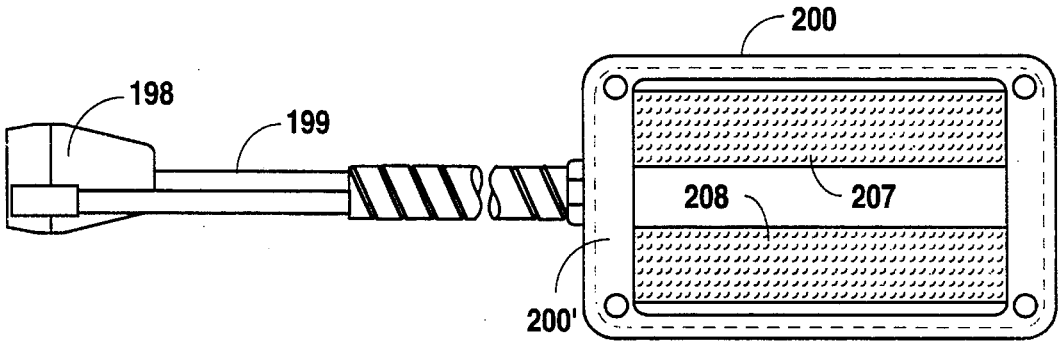

Referring to FIG. 12A–12C, the external details of the hand control 200 are readily apparent. Notably, the back side 300 of hand control 200 (shown in FIG. 12C) is provided with two strips 207 and 208 of Velcro hook material for enabling releasable mounting of hand control 200 either in siderail bracket 271 or on the outer side of footboard 96 of bed 10 (FIG. 1). Mating strips of Velcro loop material are adhered both in bracket 271 and to the outer side of footboard 96 to further enable this.

In operation, bed 10 is intended to be installed in the home setting although bed 10 may be equally beneficial in many other settings. For a more complete understanding of the how to make and use frame assembly 20, refer to the assembly and disassembly procedure attached hereto as Exhibits A and B and incorporated herein in their entirety by this reference.

Thus, bed 10 is especially designed to help provide pressure relief to a patient in the home. It can be disassembled, transported and re-assembled by one person, and can be transported upstairs and through narrow hallways and doorways due to its versatile construction and light-weight components. The air cushions 31–33 are attached to each other with zippers 61 and 62 and attached to the foam pad 34 below with Velcro straps 63–66. The cover sheet 11 envelopes the air cushions 31–33 and foam sub-mattress 34 and is held in place by its eight Velcro straps 11*a–d* looped through slots 24*a–d* and 25*a–d* in the hard-pan surfaces 21*a–c* of frame assembly 20. Once looped through such slots 24*a–d* and 25*a–d*, the Velcro straps 11*a–d* fasten back again onto themselves on the cover sheet 11. Conventional bed sheets can be tucked between the hard-pan surfaces 21*a–c* of the bed 10 and the magnets 51 sewn into lower sheet 42 of the foam pad cover 40. The central connection of the sub-mattress 34 near the lateral center of the hard-pan surfaces 21*a–c* further enables tucking-in of such sheets 44 while still maintaining secure positioning of mattress assembly 50 atop the hard-pan surfaces 21*a–c*. The foam sub-mattress 34 is designed to provide pressure reduction for the patient during power outage and to provide comfortable support when the cushions 31–33 are deflated for patients to enter or exit bed 10.

Although the present invention has been described in terms of the foregoing preferred embodiments, this description has been provided by way of explanation only and is not to be construed as a limitation of the invention, the scope of which is defined by the following claims.

Accordingly, it should be understood that many omissions, additions, substitutions, modifications and equivalents may be made while still capturing the essence of the present invention. The frame assembly 20 or parts thereof for instance might be omitted or replaced while still appreciating certain aspects of the invention. Many other changes will be evident to those of skill in the art. It should also be understood that many such changes may sacrifice certain but not all aspects of the invention, while still falling within the spirit and scope thereof, as defined by the appended claims.

I claim:

1. An inflatable mattress system comprising:

a first inflatable air cushion positioned to support the seat portion of a patient;

a second inflatable air cushion positioned to support another portion of the patient; and a source of pressurized gas in fluid communication with an inlet opening in the first air cushion and an inlet opening in the second air cushion for inflating the same;

said source being in unrestricted fluid communication with the inlet opening in the first air cushion;

said source comprising at least a first and a second control for controlling the flow of air to the first and second air cushions;

said first control being operable to adjust the output of a blower integral with said source, the outlet of which is in fluid communication with each of the said first and second cushions for inflating the same; and said second control being an adjustable flow restricting device for controlling the flow from the blower unit to the second inflatable air cushion.

2. The inflatable mattress system of claim 1, further comprising:

releasable connectors mounted to each of the first and second air cushions for releasably connecting the first and second air cushions directly to one another in a predetermined configuration relative to one another for forming an inflatable mattress.

3. The inflatable mattress system of claim 1, further comprising:

a third inflatable air cushion positioned adjacent said first cushion on a side that is opposite the said second inflatable air cushion;

said source of pressurized gas also being in fluid communication with an inlet opening in the third air cushion for inflating the same; and said source further comprising a third control for controlling the flow of air to the third air cushion.

4. The inflatable mattress system of claim 1, further comprising a sculpted foam sub-mattress positioned beneath said first and second cushions.

5. The inflatable mattress system of claim 4, further comprising a frame for supporting the said air cushions and the said sub-mattress.

* * * * *